US006647728B2

(12) United States Patent
Seitz

(10) Patent No.: US 6,647,728 B2
(45) Date of Patent: Nov. 18, 2003

(54) METHOD FOR OPERATING A TURBINE AND TURBINE INSTALLATION

(75) Inventor: Robert Seitz, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/182,800

(22) PCT Filed: Dec. 19, 2000

(86) PCT No.: PCT/EP00/12965

§ 371 (c)(1),
(2), (4) Date: Aug. 2, 2002

(87) PCT Pub. No.: WO01/57366

PCT Pub. Date: Aug. 9, 2001

(65) Prior Publication Data

US 2003/0012639 A1 Jan. 16, 2003

(30) Foreign Application Priority Data

Feb. 2, 2000 (EP) ..... 00102052

(51) Int. Cl.[7] ..... F01K 13/02
(52) U.S. Cl. ..... 60/660; 60/645

(58) Field of Search ..... 60/660, 652, 645

(56) References Cited

U.S. PATENT DOCUMENTS 4,071,897 A * 1/1978 Groves et al. ..... 700/290
4,228,359 A * 10/1980 Matsumoto et al. ..... 290/40 R
4,240,077 A * 12/1980 Hughes et al. ..... 340/500
4,578,944 A * 4/1986 Martens et al. ..... 60/39.182
4,589,255 A * 5/1986 Martens et al. ..... 60/646
4,655,041 A 4/1987 Del Vecchio et al.
4,665,041 A * 5/1987 Higuchi et al. ..... 501/134
5,157,619 A * 10/1992 Palusamy et al. ..... 702/43

FOREIGN PATENT DOCUMENTS

EP 0128593 * 12/1984

* cited by examiner

*Primary Examiner*—Hoang Nguyen
(74) *Attorney, Agent, or Firm*—Harness, Dickey & Pierce, P.L.C.

(57) ABSTRACT

The thermal load to which a turbine is subjected is kept within an acceptable range by monitoring the change in temperature of the medium that is supplied to the turbine, especially fresh stream, over time. An emergency trip for the supply of fresh steam to the turbine preferably takes place if a maximum temperature gradient is exceeded.

19 Claims, 3 Drawing Sheets

METHOD FOR OPERATING A TURBINE AND TURBINE INSTALLATION

This application is the national phase under 35 U.S.C. §371 of PCT International Application No. PCT/EP00/12965 which has an International filing date of Dec. 19, 2000, which designated the United States of America and which claims priority on European Patent Application No. 00102052.8 filed Feb. 2, 2000, the entire contents of which are hereby incorporated by reference.

FIELD OF THE INVENTION

The invention generally relates to a method for operating a turbine and to a turbine installation.

BACKGROUND OF THE INVENTION

In industrial installations, for example in installations for generating electricity, a gaseous medium is supplied to a turbine in order to drive it. As a rule, the turbine is connected to a generator for generating electrical energy or, for example, it drives a compressor or a pump. In the case of a steam turbine, the gaseous medium is live steam. Before it is supplied to the turbine, this live steam is heated in a boiler, which is connected upstream of the turbine.

A method and an appliance for recording and evaluating undesirable temperature and pressure changes is described in D1U.S. Pat. No. 4,655,041 (DEL VECCHIO RICHARD J ET AL) Apr. 7, 1987 (1987-04-07). The temperature and the pressure of the steam flowing in a turbine are cyclically measured and compared with specified values. If the specified values are exceeded, an alarm occurs.

A first alarm occurs if the temperature becomes greater than a specified maximum temperature or less than a specified minimum temperature or the pressure becomes greater than a maximum pressure or less than a minimum pressure. The permissible temperature range is located between the maximum temperature and the minimum temperature. The permissible pressure range is located between a maximum pressure and a minimum pressure.

A second alarm occurs if the temperature and the pressure are outside the permissible temperature range or the pressure range, and the temperature change and/or pressure change exceeds a previously determined value.

A third alarm occurs if the temperature and the pressure are outside the permissible temperature range or the pressure range, and the temperature change and/or pressure change exceed, a specified maximum value.

SUMMARY OF THE INVENTION

An object is achieved, according to an embodiment of the invention, by a method for operating a turbine, in particular a steam turbine to which a gaseous medium is supplied, wherein a change with time of the temperature of the medium is monitored.

The monitoring of the temperature change, i.e. the observation of the variation in the temperature gradient, may be based on the consideration that an excessively rapid temperature change—even if it lies within the permitted temperature range between the absolute limiting values—can lead to turbine damage. This is because in the case of an excessively rapid temperature change, or on the occurrence of temperature steps, material problems occur, under certain circumstances, which have a disadvantageous effect, particularly on the efficiency of the turbine. Further, they may lead, under certain circumstances, to cracks and to fracture of the material. Compared with conventional methods, which only monitor whether the temperature exceeds a specified absolute limiting value, this achieves a clearly improved protective function.

The monitoring of the temperature change therefore opens the possibility of having already taken appropriate preventive measures in the case of an excessively large or an excessively rapid change in temperature.

When a maximum temperature gradient, as a measure for the change with time of the temperature, is exceeded, the supply of the medium to the turbine is preferably interrupted by executing a rapid shut-down. Consequently, the method permits a certain value of the temperature change. If this value is exceeded, in particular for a longer period, the supply of the live steam is interrupted in order to protect the turbine from an excessively large thermal stress.

In a preferred embodiment, the maximum permissible temperature gradient is specified as a function of the load condition of the turbine and particularly, in fact, in such a way that the maximum permissible temperature gradient becomes smaller with increasing load. This is based on the consideration that in the case of low load conditions, the heat transfer from the live steam to the material of the turbine is small, in particular because of the low density and the low velocity of the live steam. In consequence, higher temperature gradients are permitted in the low-load range without the danger of turbine damage occurring.

In addition to the monitoring of the temperature change, the supply of the medium to the turbine may be expediently interrupted when an absolute limiting value for the temperature is exceeded. A permissible absolute temperature range, within which the live steam temperature can vary, may therefore be specified.

In order to restrict the complication necessary for the monitoring, provision may advantageously be made for the actual value of the current temperature of the live steam to be cyclically scanned. The change in temperature and the temperature gradient may be determined by comparing successive actual values.

In a particularly advantageous embodiment, a dynamic limiting value is specified as a function of the actual value, which dynamic limiting value changes with the variation of the temperature but, as a maximum, within the compass of the maximum temperature gradient. The specification of the dynamic limiting value therefore defines a temperature range within which temperature fluctuations are permitted. This dynamic procedure takes account of permitted temperature changes, for example a continuous increase during starting. This avoids the danger of an erroneous initiation of the protective function.

Because temperature changes can occur in both directions, a lower dynamic limiting value and an upper dynamic limiting value are preferably specified. In this arrangement, the limiting values are preferably specified in such a way that they differ from the actual value by a defined temperature value. The defined temperature value therefore provides a fixed temperature range between the actual value and the upper dynamic limiting value and the lower dynamic limiting value, provided no extraordinary temperature changes occur. If, namely, temperature gradients occur which exceed the maximum permissible temperature gradient, the distance between the actual value and one of the dynamic limiting values diminishes appreciably until it finally exceeds the limiting value. The actual value curve therefore intersects the curve of the dynamic limiting value when the maximum temperature gradient is exceeded.

The fact that the dynamic limiting value has been exceeded is advantageously employed as an indication of an unallowable temperature change and the supply of the medium to the turbine is interrupted.

In order to avoid an excessively rapid initiation of the protective function, for example because of short-term electrical effects, the supply of the medium to the turbine is only interrupted, after the dynamic limiting value or the absolute limiting value has been exceeded, when the dynamic limiting value or the absolute limiting value continues to be exceeded after at least one further control scanning cycle. A certain time buffer is therefore introduced by awaiting at least one further control scanning cycle.

After the dynamic limiting value or the absolute limiting value has been exceeded, the scanning cycle is then preferably shortened, i.e. the temperature measurement is repeated at shorter intervals. In this way, the temperature scanning frequency is matched to the requirement in an advantageous manner, i.e. in the case of a normal variation, the temperature is scanned relatively seldom and, in the case of a critical variation, the temperature is scanned more frequently.

In an expedient embodiment, provision is made for the first newly measured actual value of the live steam temperature to be used to determine the dynamic limiting value in the case of a starting procedure of the turbine and/or after a fault in the monitoring of the temperature variation. This ensures a reliable mode of operation of the protective function furnished by the monitoring of the temperature change and, for example, it avoids the storage and use of the last actual value, measured before the turbine was switched off, in the determination of the dynamic limiting values. This is because this latter procedure would result, in the case of a renewed starting of the turbine, in the protective function being necessarily initiated and, therefore, the live steam supply being shut off, should the stored actual value be clearly different from the current actual value. The closing of a generator switch, in the case of a generator turbine, and the fact that there has been a departure from the minimum drive speed in the case of a driving turbine are advantageously employed as the criterion for switching on the protective function.

So that operating personnel already have an indication of a possible danger in the case of unusual temperature changes, an alarm advantageously may occur when the actual value approaches the dynamic limiting value and/or the absolute limiting value. In particular, this alarm occurs when the actual value approaches a specified distance from one of the limiting values. The alarm occurs acoustically and/or optically, for example.

In order to permit the protective function to be, as far as possible, initiated in good time, the temperature variation of the medium is monitored before the inlet of the medium to the turbine and particularly, in fact, in the region of a boiler connected upstream of the turbine or even directly after a so-called steam collecting vessel. In the case of an unallowable temperature change, therefore, the rapid shut-down takes place before the excessively cold or excessively hot steam reaches the turbine.

The protective mechanism, i.e. the possibility of preventing the supply of the medium to the turbine, can preferably only be activated when the turbine is operated below a specified load. By this means, the protective function is, in particular, not activated during the starting of the turbine. This does not impair the safety because, in this condition and in low-load operation, the danger of damage due to temperature changes is relatively small.

An object may additionally be achieved by a turbine installation, having a turbine which can be operated by a gaseous medium, having a temperature sensor for recording the temperature of the medium and having a protective device for determining the temperature variation and for interrupting the supply of the medium to the turbine when a temperature gradient is exceeded.

The advantages and expedient embodiments mentioned with respect to the method are to be transferred mutatis mutandis to the turbine installation.

BRIEF DESCRIPTION OF THE DRAWINGS

An embodiment example of the invention is explained in more detail using the figures. In these.

DETAILED DESCRIPTION OF THE PREFERRED EMBODIMENTS

Figure 1:
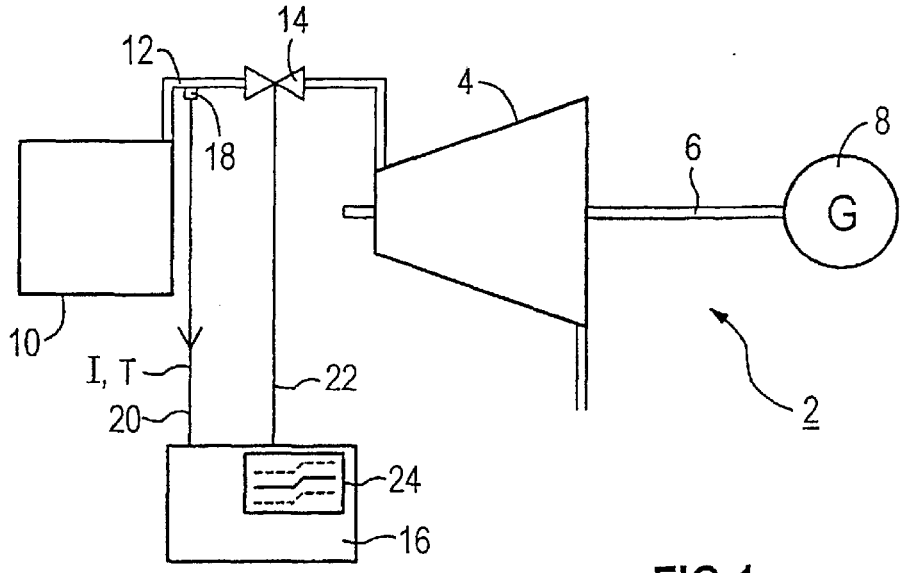
FIG. 1 shows a turbine installation in a greatly simplified diagrammatic representation.

The turbine installation 2 shown in FIG. 1 includes a turbine 4, in particular a steam turbine, which is connected via a shaft 6 to a generator 8 for the purpose of generating electrical energy. The turbine is driven by a gaseous medium, in particular by live steam. The live steam is generated in a boiler 10 and is conducted from there via a steam main 12 to the turbine 4. The steam main 12 can be shut off via a valve 14, in particular a quick-closing valve. The turbine installation 2 includes, furthermore, a protective device 16 and a temperature sensor 18 which, in the embodiment example shown in FIG. 1, is attached directly to the steam main 12 in the immediate region of the boiler 10. The protective device 16 is in connection, via a data line 20, with the temperature sensor 18 and, via a control line 22, with the valve 14. If required, the turbine protective device is activated via the control line 22 and a rapid shut-down is initiated.

The temperature sensor 18 is used for recording an actual value I of the temperature T of the live steam. The measured actual valve I is conveyed to the protective device 16 and is there stored and evaluated. The actual valve I is cyclically scanned by the protective device 16, the period of the scanning cycle being, for example, six seconds. The variation with time of the temperature T of the live steam recorded in this way by the protective device 16 is preferably displayed optically by a display 24, in particular a monitor screen or a digital measuring unit.

The protective device 16 decides whether the valve 14 is to be actuated as a function of the change in the measured actual valve I in its variation with time, i.e. as a function of the temperature gradient dT/dt determined from the measured actual valves I. A rapid shut-down is preferably initiated in the case of actuation so that the turbine 4 is cut off from the supply of live steam. The rapid closure of the valve 14 is used to protect the turbine from thermal damage, for example in the form of cracks due to excessive temperature changes. the rapid shut-down is, in addition, also activated when the measured actual valve I becomes less than or greater than an absolute limiting value. A high-level protective function for the turbine 4 is made available by such monitoring of the temperature T.

So that the measured actual valve I corresponds as far as possible to the actual temperature T of the live steam, the temperature sensor 18 can be embodied as a high-speed thermocouple, which is distinguished by the fact that its metal contact is directly applied to a so-called immersion tube of the steam main 12. The differences between the measured actual valve I and the actual temperature T caused by systematic measurement errors are preferably automatically corrected by the protective device 16. For simplicity, it is assumed below that the measured actual valve I corresponds to the actual temperature T.

The internal decision process within the protective device 16 is explained in more detail below using FIGS. 2 to 5. In each of the figures, the temperature T is plotted against the time t. Three temperature variations are, in total, shown in the representation, namely the temperature curve 28 of the temperature T of the live steam and an upper dynamic temperature curve 30 and a lower dynamic limiting value curve 32. The temperature curve 28 is formed from a number of discrete actual valves I, which are recorded by the control device 16, and of which one is presented as an example. An upper dynamic limiting value OG and a lower dynamic limiting value UG is associated with each measured actual valve I. The individual discrete dynamic limiting values OG, UG form the two dynamic limiting value curves 30, 32.

In order to monitor the temperature T of the live steam, the following procedure may be applied for each scanning cycle—the measured actual valve I is compared with the dynamic limiting values OG, UG:

Case A: the actual valve I is smaller than the upper limiting value OG and larger than the lower limiting value UG. The dynamic limiting values OG, UG are specified afresh.

In the case of the upper limiting value OG, this takes place, on the one hand, by the newly measured actual valve I being added to a defined temperature value X. On the other hand, the previous upper limiting value OG is increased by a change value Y.

In order to determine the new upper limiting value OG, the sum (I+X) of the actual valve I and the temperature value X is now compared with the sum (OG+Y) of the previous upper limiting value OG and the change value Y. The lower summation value is defined as the new upper limiting value OG.

The determination of the lower limiting value UG similarly takes place in such a way that the temperature value X is subtracted from the actual valve I and the change value Y is subtracted from the lower limiting value UG, and that the larger summation value is specified as the new lower limiting value UG.

In this procedure, the change value Y is dimensioned to accord with the maximum permissible temperature gradient dT/dt(max) of the temperature T of the live steam. And, in fact, the change dY/dt of the change value Y corresponds to the maximum temperature gradient dT/dt. A value of 3 K/min is, for example, used as the maximum temperature gradient dT/dt(max). In the case of a scanning cycle of preferably six seconds, this corresponds to 0.3 K/scanning cycle. In this case, the change value Y is, correspondingly, 0.3 K.

The limiting value curves 30, 32 determined in accordance with this prescription form a permitted temperature band 34, within which the temperature curve can vary without a rapid shut-down being initiated. This temperature band 34 is dynamic and follows the variation of the temperature curve 28. It is only in the case of very rapid and continuing temperature changes that the temperature curve 28 departs from the permitted temperature band 34. This leads to Case B, in which the actual valve I lies above the upper limiting value OG or under the lower limiting value UG. The automatic activation of the rapid closure of the valve 14 preferably takes place after a control phase. This is explained more precisely and in detail with respect to FIG. 3.

Figure 2:
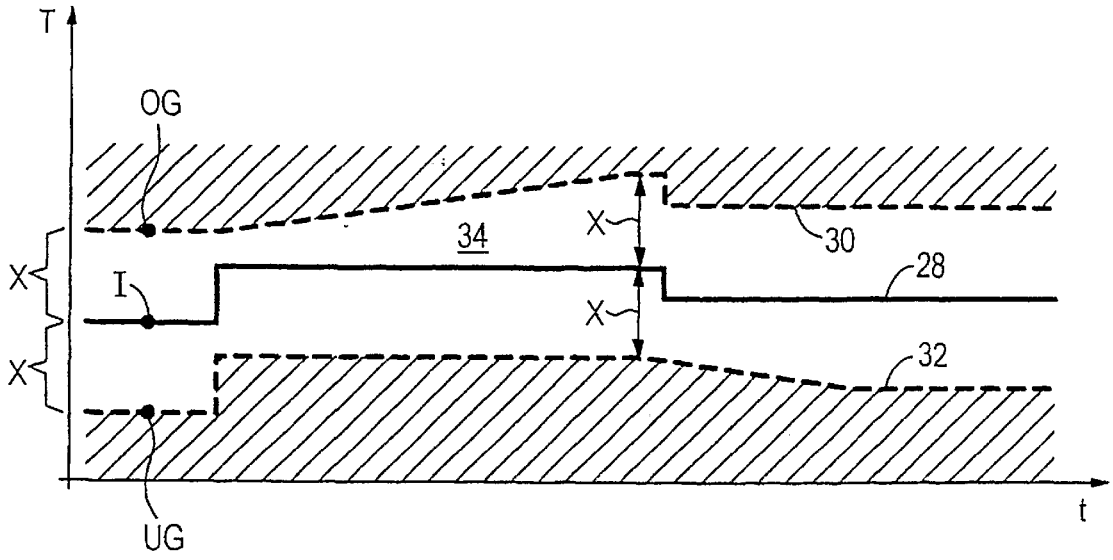
FIGS. 2 to 5 show different temperature variations of the live steam temperature with the curves of the associated dynamic limiting values.

As shown in FIG. 2, the temperature curve 28 exhibits two discontinuity locations in an otherwise horizontal variation. In this curve, the temperature T steps up once abruptly and drops once abruptly. After the increase, the temperature curve 28 initially runs close to the upper dynamic limiting value curve 30 which, in accordance with the algorithm described above, is gradually displaced to higher temperature values until, finally, it is at a distance from the temperature curve 28 fixed by the temperature value X. The increase in the upper limiting value curve 30 is determined by the variation with time of the change value dY/dt.

In contrast to the upper limiting value curve 30, the lower limiting value curve 32 follows the step in the temperature curve 28 directly, i.e. the lower limiting value 32 likewise exhibits a step. This results from the fact that in order to calculate the new lower limiting value UG, the actual valve I less the temperature value X is decisive. In the case of a step with reverse sign, i.e. in the case of a stepwise drop in the temperature curve 28, the same applies for the limiting value curves 30, 32 in such a way that the lower limiting value curve 32 is now gradually displaced to lower temperature values and the upper limiting value curve 30 is pulled stepwise downward.

Figure 3:
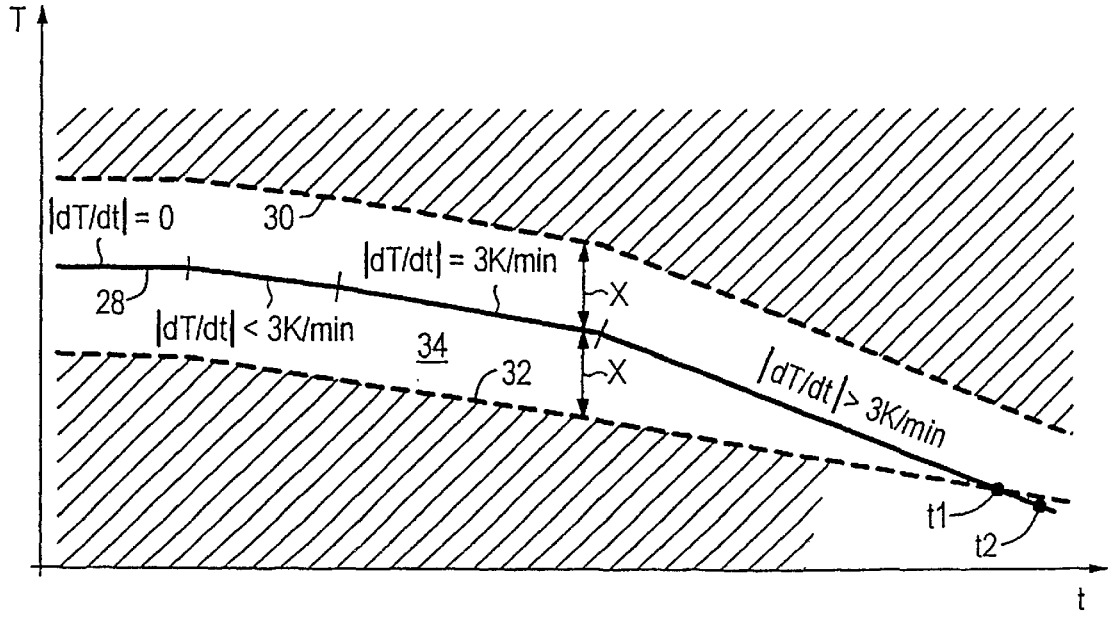

As shown in FIG. 3, according to which Case B—i.e. the initiation of the protective function—is explained, the temperature curve 28 is subdivided into four partial regions. Within these partial regions, the temperature gradient dT/dt becomes continually larger and, in the fourth partial region, exceeds the maximum temperature gradient dT/dt of 3 K/min. It may be seen that the limiting value curves 30, 32 follow the temperature curve 28, initially retaining the distance by the temperature value X, until the temperature gradient dT/dt becomes too large in the fourth partial region. The temperature curve 28 then runs out of the temperature band 34 and intersects the lower limiting value curve 32 at a time t1. As soon as this occurs, the scanning cycles are advantageously shortened from six seconds to two seconds, for example. If, preferably after three further short cycles, the actual valve I still lies under the limiting value curve 32, a rapid shut-down takes place at the time t2. Awaiting further control cycles with shorter scanning cycle ensures that a singular event, for example a measurement error or another electrical effect, does not lead to the initiation of the rapid shutdown.

Figure 4:
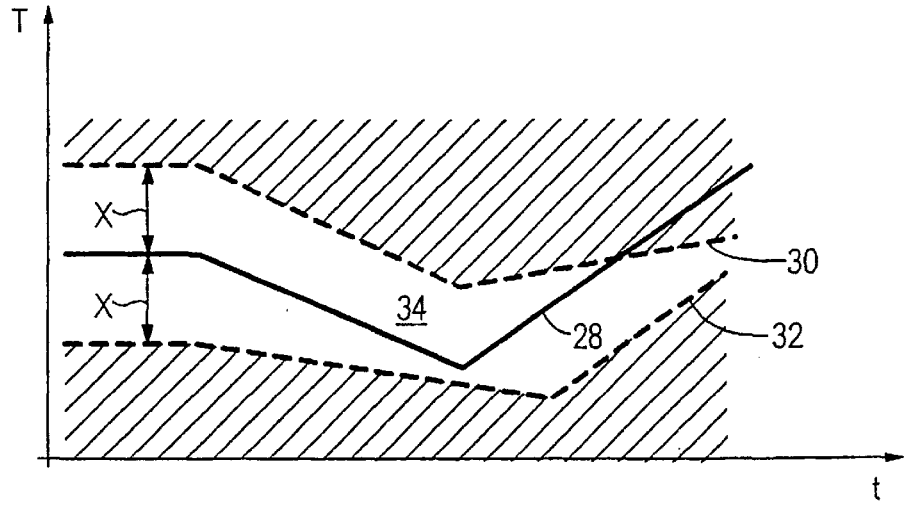
Figure 5:
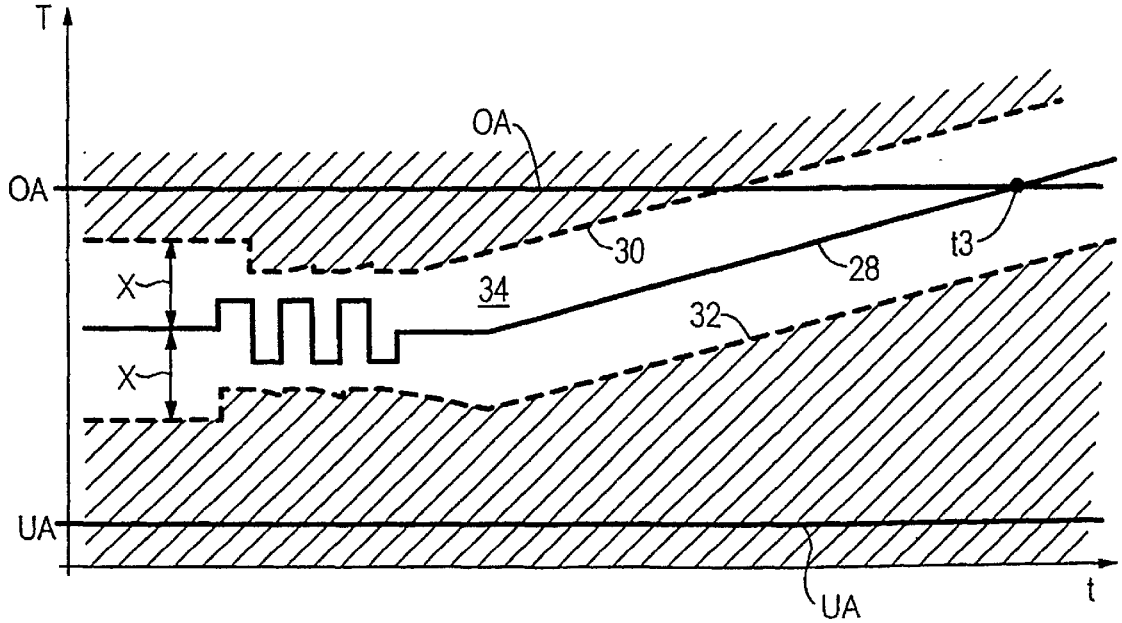

FIGS. 4 and 5 show further typical temperature variations 28 with the corresponding variations of the limiting value curves 30 and 32. As may be seen from FIG. 5, a stepwise alternating change to the temperature curve 28 has the result that the temperature band 34 narrows appreciably. It is only when the temperature curve 28 again assumes a continuous variation that the temperature band 34 widens, so that the limiting value curves 30, 32 are at a distance from the temperature curve 28 by the temperature value X.

In addition to the dynamic limiting value curves 30, 32, FIG. 5 includes an upper absolute limiting value OA and a lower absolute limiting value UA as thick lines. As may be further seen from FIG. 5, the temperature curve 28 intersects the horizontal line representing the upper limiting value OA at a time t3, which leads to initiation of the rapid shut-down. In addition to monitoring the temperature gradient dT/dt, the protective device 16 therefore also monitors whether the temperature T of the live steam is greater than or less than the absolute limiting values OA and UA.

Figure 6:
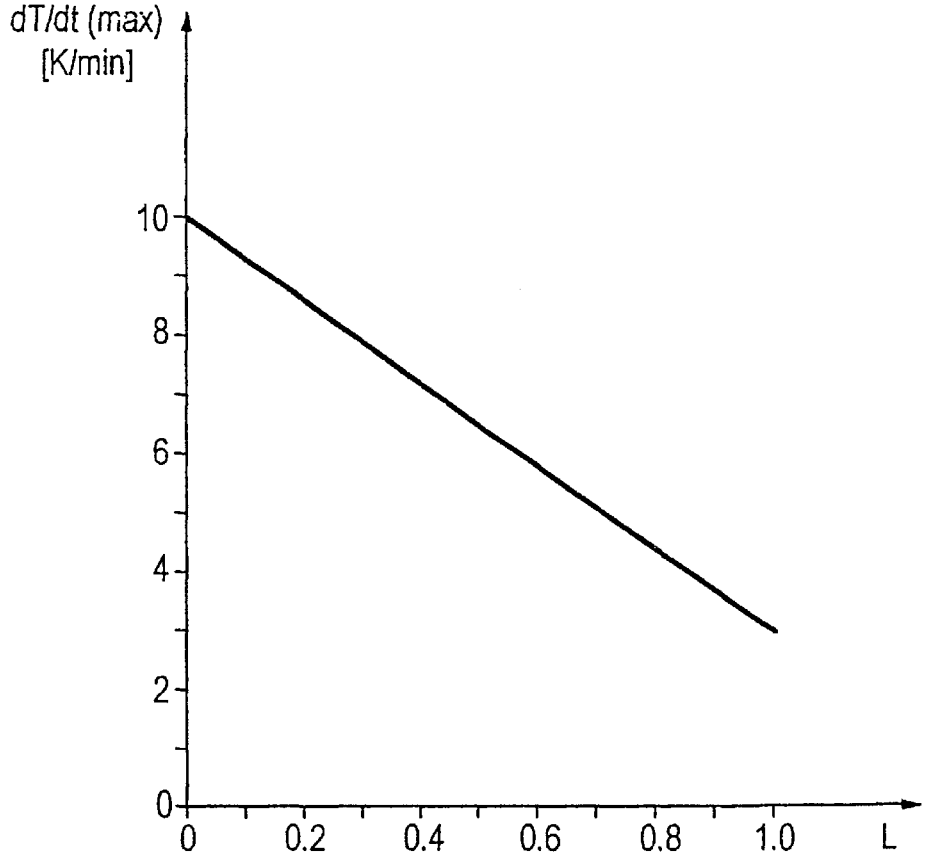
FIG. 6 shows the variation of a maximum permissible temperature gradient with the load condition of the turbine.

As shown in FIG. 6, the maximum temperature gradient dT/dt(max) decreases with increasing load condition L. The maximum temperature gradient dT/dt(max) at very low load condition L is preferably approximately 10 k/min and falls linearly to approximately 3 k/min in full-load operation. The load condition L is given in FIG. 6 as a relative parameter between 0 and 1. This dependency of the maximum temperature gradient dT/dt(max) is possible without sacrifice of safety because, in the case of low-load operation, the heat transfer from the live steam to the turbine 4 is less than it is in the case of full-load operation. In a simplified embodiment, the maximum temperature gradient dT/dt (max) is preferably specified as a minimum value independent of the load condition L.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A method for operating a turbine to which a gaseous medium is supplied, comprising:

monitoring a change with time of a temperature of the medium; and interrupting a supply of the medium to the turbine when a maximum temperature gradient dT/dt(max) is exceeded, wherein the maximum permissible temperature gradient dT/dt(max) is specified as a function of a load condition of the turbine.

2. The method as claimed in claim 1, comprising:

specifying a dynamic limiting value as a function of an actual value of the current temperature, wherein the dynamic limiting value changes with the variation of the temperature but, as a maximum, within a compass of the maximum temperature gradient (dT/dt(max)).

3. The method as claimed in claim 2, wherein a lower dynamic limiting value and an upper dynamic limiting value are specified.

4. The method as claimed in claim 2, wherein the dynamic limiting value is specified as differing from the actual value by a defined temperature value.

5. The method as claimed in claim 2, wherein the supply of the medium to the turbine is interrupted when the dynamic limiting value is exceeded.

6. The method as claimed in claim 5, wherein, after at least one of the dynamic limiting value and the absolute limiting value is exceeded, the supply of the medium to the turbine is only interrupted when the at least one of the dynamic limiting value and the absolute limiting value continues to be exceeded after at least one further control scanning cycle.

7. The method as claimed in claim 6, wherein the scanning cycle is shortened after the at least one of the dynamic limiting value and the absolute limiting value has been exceeded.

8. The method as claimed in claim 2, wherein the first newly measured actual value is used to determine the dynamic limiting value in the case of at least one of a starting procedure of the turbine and after a fault in the monitoring of the temperature variation.

9. The method as claimed in claim 2, wherein an alarm occurs when the actual value approaches at least one of the dynamic limiting value and the absolute limiting value.

10. The method as claimed in claim 2, wherein the supply of the medium to the turbine can only be shut off when the turbine is operated above a specified load condition.

11. The method of claim 1, wherein the method is for operating a steam turbine.

12. The method of claim 1, wherein the maximum permissible temperature gradient (dT/dt(max)) becomes smaller with increasing load condition.

13. The method of claim 11, wherein the maximum permissible temperature gradient (dT/dt(max)) becomes smaller with increasing load condition.

14. The method as claimed in claim 12, comprising:

specifying a dynamic limiting value as a function of an actual value of the current temperature, wherein the dynamic limiting value changes with the variation of the temperature but, as a maximum, within a compass of the maximum temperature gradient (dT/dt(max)).

15. The method as claimed in claim 14, wherein the supply of the medium to the turbine is interrupted when the dynamic limiting value is exceeded.

16. The method as claimed in claim 15, wherein, after at least one of the dynamic limiting value and the absolute limiting value is exceeded, the supply of the medium to the turbine is only interrupted when the at least one of the dynamic limiting value and the absolute limiting value continues to be exceeded after at least one further control scanning cycle.

17. The method as claimed in claim 16, wherein the scanning cycle is shortened after the at least one of the dynamic limiting value and the absolute limiting value has been exceeded.

18. The method as claimed in claim 14, wherein an alarm occurs when the actual value approaches at least one of the dynamic limiting value and the absolute limiting value.

19. The method as claimed in claim 14, wherein the supply of the medium to the turbine can only be shut off when the turbine is operated above a specified load condition.

* * * * *